US005498934A

United States Patent [19]

Nilssen

[11] Patent Number: 5,498,934

[45] Date of Patent: Mar. 12, 1996

[54] ELECTRONIC FLASHLIGHT

[76] Inventor: Ole K. Nilssen, 408 Caesar Dr., Barrington, Ill. 60010

[21] Appl. No.: 301,731

[22] Filed: Sep. 7, 1994

Related U.S. Application Data

[63] Continuation of Ser. No. 652,378, Feb. 7, 1991, abandoned, which is a continuation of Ser. No. 410,745, Sep. 22, 1989, abandoned.

[51] Int. Cl.[6] ..... H05B 37/02

[52] U.S. Cl. ..... 315/224; 315/291; 315/175; 362/205

[58] Field of Search ..... 315/291, 175, 315/171, 172, DIG. 4, 224; 362/205

[56] References Cited

U.S. PATENT DOCUMENTS

| | | | |
|---|---|---|---|
| 3,885,148 | 5/1975 | Di Benedetto | 362/205 |
| 3,935,505 | 1/1976 | Spiteri | 315/291 |
| 4,286,195 | 8/1981 | Swinea, Jr. | 315/291 |
| 4,358,713 | 11/1982 | Senoo et al. | 315/291 |
| 4,358,714 | 11/1982 | Sechler et al. | 315/291 |
| 4,499,525 | 2/1985 | Mallory | 362/157 |
| 4,527,223 | 7/1985 | Maglica | 362/205 |
| 4,739,226 | 4/1988 | Murata | 315/287 |
| 4,777,427 | 10/1988 | Kiyohara | 323/222 |
| 4,887,006 | 12/1989 | Kuratani | 315/291 |

FOREIGN PATENT DOCUMENTS

| | | | |
|---|---|---|---|
| 2353345 | 10/1973 | Germany | 323/222 |

*Primary Examiner*—Frank Gonzalez
*Assistant Examiner*—Reginald A. Ratliff

[57] ABSTRACT

Connected in circuit between the battery and the light bulb in a flashlight is a slide switch and an electronic forward converter. The slide switch has an OFF-position, an ON-position, and a spring-loaded variable BOOST-position. In full BOOST, the electronic forward converter operates such as to increase the magnitude of the voltage applied to the light bulb by a factor of about 1.5; thereby increasing the light output from the flashlight by a factor of about 4.0. However, at that degree of BOOST, if indeed maintained on a continuous basis, the life of the light bulb will be shortened to about 15 minutes versus about 50 hours when used in the normal ON-position.

11 Claims, 2 Drawing Sheets

ELECTRONIC FLASHLIGHT

This application is a continuation of U.S. application Ser. No. 07/652,378 filed on Feb. 7, 1991, now abandoned, which is a continuation of U.S. application Ser. No. 07/410,745 filed on Sep. 22, 1989 now abandoned.

BACKGROUND OF THE INVENTION

1. Field of the Invention

The present invention relates to flashlights and similar battery-powered light sources.

2. Background of the Invention

Flashlights are well known products; which, in many situations provide much less light than might be wanted.

SUMMARY OF THE INVENTION

1. Objects of the Invention

An object of the present invention is the provision of cost-effective means whereby the light output from a battery-powered light source, such as a flashlight, might be boosted beyond what normally would be obtained.

This as well as other objects, features and advantages of the present invention will become apparent from the following description and claims.

2. Brief Description

Connected in circuit between the battery and the light bulb in a flashlight is a slide switch and an electronic forward converter. The slide switch has an OFF-position, an ON-position, and a variable BOOST-position; which variable BOOST-position is spring-loaded so as automatically to return to the ON-position if no external force is applied. At maximum BOOST, the electronic forward converter operates such as to increase the magnitude of the voltage applied to the light bulb by a factor of about 1.5; thereby increasing the light output from the flashlight by a factor of about 4.0. However, at that degree of BOOST, if indeed maintained on a continuous basis, the life span of the light bulb would be shortened by a factor of about 200 compared with its life span at normal operating voltage, In particular, a flashlight bulb has a normal life span of about 50 hours; and, at maximum BOOST, if maintained, this life span would be reduced to about 15 minutes.

DESCRIPTION OF THE PREFERRED EMBODIMENT

Details of Construction

Figure 1:
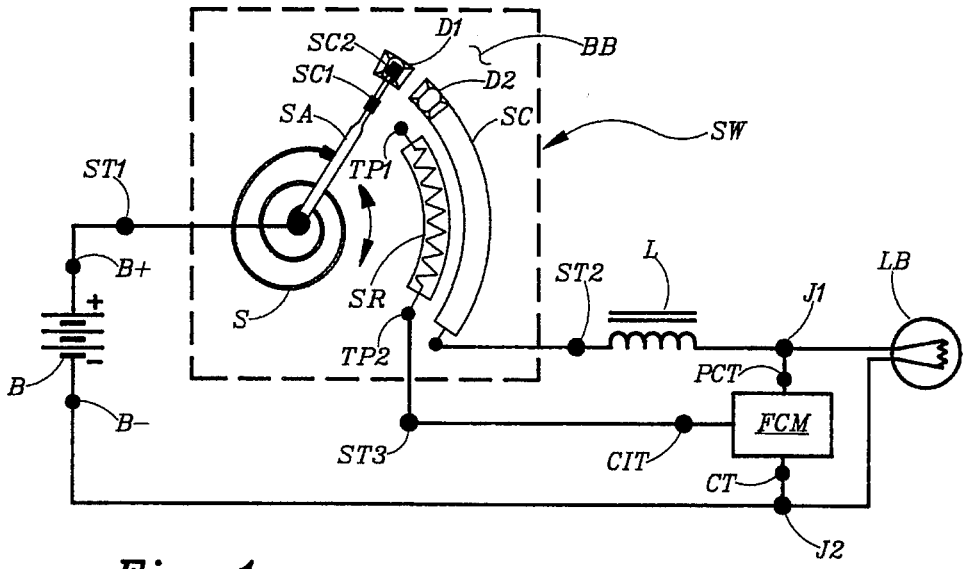
FIG. 1 schematically illustrates the invention in its preferred embodiment.

FIG. 1 schematically illustrates the preferred embodiment of the invention in the form of an electrical circuit diagram.

In FIG. 1, a battery B has a B+ terminal and a B− terminal. The B+ terminal is connected with a switch terminal ST1 of a slide switch SW; which switch terminal, in turn, is connected with a slideable arm SA of slide switch SW. Slideable arm SA is connected with a spring S, and has first and second slide contactors SC1 and SC2, as well as a slide conductor SC and a slide resistor SR. Slide conductor SC and slide resistor SR are both mounted on a back board BB; in which back board there is a first detent D1. Slide conductor SC, in which there is a second detent D2, is connected with a switch terminal ST2. Slide resistor SR has a first terminal point TP1 and a second terminal point TP2; which second terminal point is connected with a switch terminal ST3.

An energy-storing inductor L is connected between switch terminal ST2 and a first junction J1; and a light bulb LB is connected between first junction J1 and a second junction J2.

A forward converter means FCM has: (i) a common terminal CT, which is connected with second junction J2; (ii) a power control terminal PCT, which is connected with first junction J1; and (iii) a control input terminal CIT, which is connected with switch terminal ST3.

Figure 2:
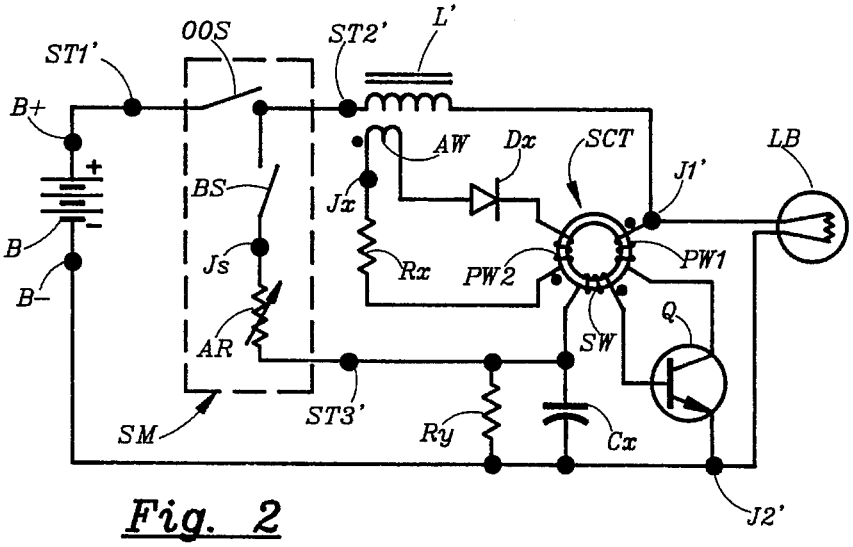
FIG. 2 diagrammatically illustrates a forward converter of a type suitable for use in the preferred embodiment.

FIG. 2 diagrammatically illustrates a forward converter of a type suitable for use in the preferred embodiment of FIG. 1.

In FIG. 2, battery B and battery terminals B+ and B− are equivalent to the corresponding elements of FIG. 1. However, slide switch SW of FIG. 1 has been replaced with a switch means SM; which has a first switch terminal St1', a second switch terminal ST2', and a third switch terminal ST3'. Within switch means SM is: (i) an ON-OFF switch OOS connected between switch terminals ST1' and ST2'; (ii) a BOOST switch BS connected between switch terminal ST2' and a junction Js; and (iii) an adjustable resistor AR connected between junction Js and switch terminal ST3'.

An energy-storing inductor L', corresponding to energy-storing inductor L of FIG. 1, is connected between switch terminal ST2' and a first junction J1'; which energy-storing inductor has an auxiliary winding AW, whose terminals are connected between the anode of diode Dx and a junction Jx.

A transistor Q is connected with its emitter to a second junction J2', and—by way of a first primary winding PW1 of a saturable current transformer SCT—is connected with its collecter to junction J1'. The base of transistor Q is connected with switch terminal ST3' by way of secondary winding SW of saturable current transformer SCT.

A resistor Rx is connected with the cathode of diode Dx by way of a second primary winding PW2 of saturable current transformer SCT. Another resistor Ry and a capacitor Cx are both connected between switch terminal ST3' and junction J2'.

Light bulb LB is connected between junctions J1' and J2'.

Figure 3:
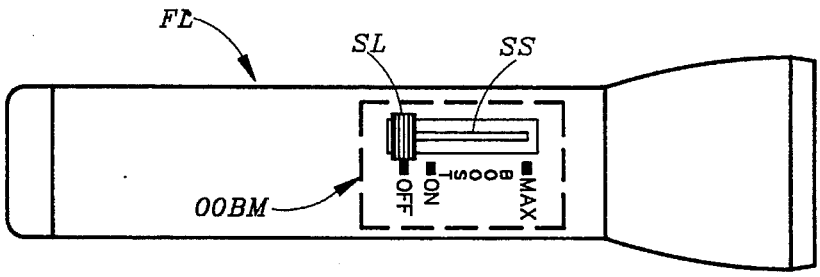
FIG. 3 illustrates a flashlight made in accordance with the invention.

FIG. 3 illustrates a flashlight FL made in accordance with the invention.

In FIG. 3, an ON/OFF/BOOST control means OOBM—which corresponds to slide switch SW of FIG. 1—has a slide lever SL slideably movable in a slide slot SS between markings OFF, ON, BOOST and MAX.

Figure 5:
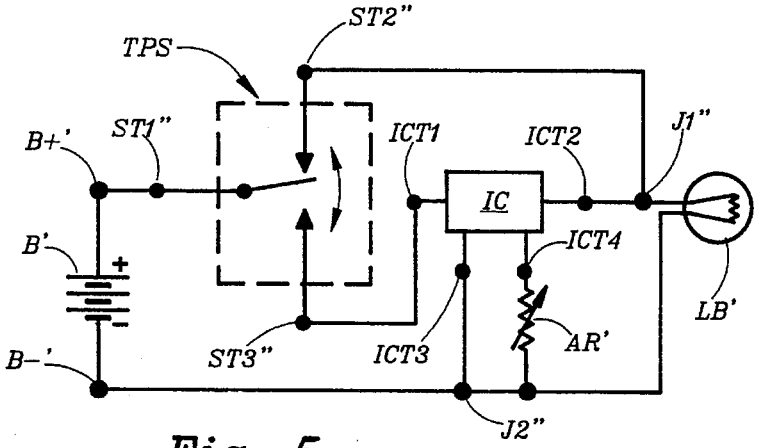
FIG. 5 schematically illustrates an alternative embodiment of the invention.

FIG. 5 schematically illustrates an alternative embodiment of the invention.

In FIG. 5, a battery B' has B+' and B−' terminals. A three-position switch TPS has: (i) a first switch terminal St1", which is connected with the B+ terminal; (ii) a second switch terminal ST2", which is connected with a first junction J1"; and (iii) a third switch terminal ST3", which is connected with a first IC terminal ICT1 of an integrated circuit IC.

A second IC terminal ICT2 is connected with first junction J1". A third IC terminal ICT3 is connected with a second junction J2"; which is also connected with the B–' terminal. A fourth IC terminal ICT4 is connected with second junction J2" by way of an adjustable resistor AR'. A light bulb LB' is connected between junctions J1" and J2".

Explanation of Waveforms

Figure 4:
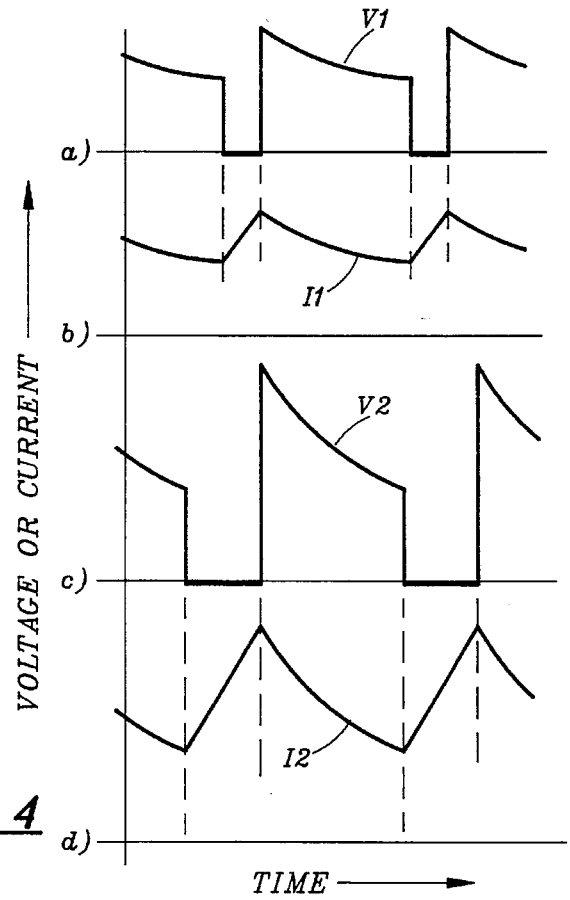
FIG. 4 shows some of the current and voltage waveforms associated with the preferred embodiment.

FIG. 4 shows some of the current and voltage waveforms associated with the arrangement of FIG. 1.

FIG. 4(*a*) shows the waveform of the voltage V1 provided across light bulb LB under a condition of providing a moderate amount of BOOST; while FIG. 4(*b*) shows the waveform of the corresponding current I1 flowing through inductor L.

FIG. 4(*c*) shows the waveform of the voltage V2 provided across light bulb LB under a condition of providing maximum amount of BOOST; while FIG. 4(*d*) shows the waveform of the corresponding current I1 flowing through inductor L.

Figure 6:
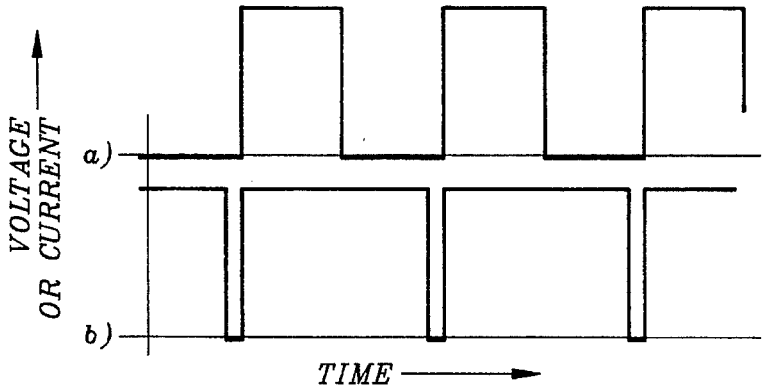
FIG. 6 shows some of the voltage waveforms associated with the alternative embodiment of the invention.

FIG. 6 shows some of the current and voltage waveforms associated with the arrangement of FIG. 5.

FIG. 6 (*a*) shows the waveform of the voltage V1' provided across light bulb LB' under a condition of providing a moderate amount of BOOST; while FIG. 6(*b*) shows the waveform of the voltage V2' provided across light bulb LB' under the condition of providing the maximum amount of BOOST.

Details of Operation

In the arrangement of FIG. 1, with slideable arm SA in the position shown, battery B is disconnected and no power flows through light bulb LB. With slideable arm SA moved from its first (or OFF) detent D1 and into its second (or ON) detent D2, the full battery voltage gets applied to light bulb LB via slide conductor SC. However, connection is not yet made with slide resistor SR; and forward conversion means FCM constitutes an open circuit between terminals PCT and CT.

Moving slideable arm SA past its ON-detent causes connection to be made between the B+ terminal and slide resistor SR, thereby causing a control current to flow into control input terminals CIT. This control current will cause forward conversion means FCM to start operating such as to cause a short circuit to occur intermittently between junctions J1 and J2.

With reference to FIG. 4, forward conversion means FCM causes a relatively brief short circuit to occur periodically between junctions J1 and J2 (see FIG. 4*a* or 4*c*). During each such brief period of short circuit, the DC voltage of battery B is applied directly across energy-storing inductor L; which means that whatever current was flowing through that inductor just prior to the onset of the short circuit will increase rapidly (see FIG. 4*b* or 4*d*). At the end of each brief period of short circuit, the by-now larger-magnitude inductor current will be switched to flow through light bulb LB. Thereafter, its magnitude will decay in an exponential manner toward the level determined by the ratio of the magnitude of the DC voltage and the magnitude of the resistance of the light bulb.

As a result, the RMS magnitude of the voltage V1 resulting across the light bulb will be larger that it was without the action of the forward conversion means. That is, the reduction in RMS magnitude resulting from the periodic brief short circuits is more than compensated-for by the increase in RMS magnitude resulting from the extra energy imparted to the energy-storing inductor during the periods when the short circuit is present and released during the periods when the short circuit is not present.

Without the action of the forward converter means, the current flowing from the battery would simply be at the level indicated by the minimum points of waveform I1. As a result of the action of the forward converter means, the average magnitude of the current drawn from the battery increases; which increased flow of current simply translates into increased power drawn from the battery; which increased power has no other place to go but into the light bulb.

By varying the duration of the short circuit period, the amount of power applied to the light bulb will vary correspondingly. FIG. 4*c* indicates a situation where the RMS magnitude of the voltage applied across the light bulb has been increased by about 50%.

Forward conversion means FCM may be made in many different ways. For instance, it could be made in the form of a custom integrated circuit expressly designed to perform the function herein specified. Or, it could be made in the manner illustrated by FIG. 2; which shows a self-oscillating single transistor oscillator.

In the circuit of FIG. 2, when switches OOS and BS are both closed, current flows through adjustable resistor AR, thereby to charge capacitor Cx.

Eventually, the voltage on Cx reaches a magnitude high enough to cause transistor Q to become conductive, at which point current will start flowing into the collector of transistor Q and thereby through primary winding PW1 of saturable current transformer SCT as well. In turn, this flow of collector current will cause additional base current to be provided to the base of transistor Q; and, by means of positive feedback, transistor Q now becomes fully conductive: sufficiently so to constitute an effective short circuit between junctions J1 and J2.

After a brief period of time, such as about 10 microseconds, saturable current transformer SCT saturates, thereby stopping the flow of base current; which therefore causes transistor Q to stop conducting. Now, the increased inductor current will flow into the light bulb; and, as a result, a voltage is induced across auxiliary winding AW; which voltage, by way of diode Dx and secondary winding PW2, is used for resetting saturable current transformer SCT, thereby to make it ready for a new cycle.

While secondary winding SW provided base current for transistor Q, this base current actually flowed out of capacitor Cx and therefore caused the voltage at terminal ST3' to become quite negative; which, as long as this negative voltage does indeed exist, prevents transistor Q from entering another cycle of positive-feedback-maintained conduction. However, current flowing through adjustable resistor AR will gradually cause the voltage at terminal ST3' again to become positive and to cause transistor Q to start conducting; whereafter transistor Q, with the help of saturable current transformer SCT, will initiate another positive-feedback-maintained period of conduction.

The lower be the magnitude of the resistance of adjustable resistor AR, the shorter be the time it takes for the negative voltage at terminal ST3' to be dissipated; and the shorter become the duration of the periods of transistor non-conduction versus the duration of the periods of transistor conduction.

For additional information with respect to the operation of single-ended self-oscillating transistor oscillators, reference is made to U.S. Patent No. Re. 32,155 to Ole Nilssen.

With respect to the operation of flashlight FL of FIG. 3, it is sufficient to mention that the light output from this flashlight is controlled as follows.

With slide lever SL in the OFF-position, no light is provided. With the slide lever in the ON-position, an ordinary amount of light is provided.

Both the OFF-position and the ON-position are detented.

Pushing slide lever SL past the detented ON-position, light output increases in approximate proportion to the degree to which the slide lever is pushed past the ON-position. When the slide lever is pushed all the way to the indicated MAX-position, the light output will be about four times higher than it is in the normal-output ON-position.

The slide lever is spring-loaded in such manner that, when pushed past the ON-position and without expressly holding it there, it will automatically return to the detented ON-position.

Whereas the arrangement of FIG. 1 is intended for a situation where the light bulb is designed to operate in its normal mode of light output, as well as to have an ordinary life expectancy, when powered with the full voltage available from the battery; the arrangement of FIG. 5 is intended for a situation where the light bulb is designed to have an unusually high level of light output, as well as an unusually short life expectancy, when powered with the full voltage of the battery.

Thus, while the task of forward conversion means FCM of FIG. 1 is that of increasing the RMS magnitude of the voltage applied to the light bulb, thereby to get increased light output in exchange for reduced bulb life expectancy; the task of integrated circuit IC of FIG. 5 is that of decreasing the RMS magnitude of the voltage applied to the light bulb, thereby to get increased bulb life expectancy in exchange for reduced light output.

Thus, in the arrangement of FIG. 5, operating the light bulb so as to attain an ordinary level of light output in combination with an ordinary life expectancy, requires a reduction of the RMS magnitude of the voltage available directly from the battery. By way of integrated circuit IC, this reduction in RMS magnitude is simply attained by connecting/disconnecting the light bulb from the battery in a rapid periodic manner, thereby to reduce the RMS magnitude of the voltage applied to the light bulb in proportion to the square root of the duty cycle. That is, compared with a 100% or unity duty cycle (where the light bulb is continuously connected with the battery) a 50% of 0.5 duty cycle (where the light bulb is connected with the battery only 50% of the time) gives rise to a reduction of RMS magnitude by a factor equal to the square root of 0.5, or equal to about 0.7.

While the arrangement of FIG. 1 requires an energy-storing inductor in order to attain a voltage magnitude boost; the arrangement of FIG. 5 does not require such an energy-storing means since it does not need to attain a voltage magnitude boost.

The function of the circuit of FIG. 5 is illustrated by the voltage waveforms of FIG. 6.

The voltage waveform of FIG. *6b* indicates a situation of near maximum BOOST; where the full battery voltage is applied to the light bulb with nearly 100% duty .cycle. The voltage waveform of FIG. *6a* indicates a situation where the full battery voltage is applied to the light bulb with less than 50% duty cycle, such as to cause the RMS magnitude of the voltage applied to the light bulb to be only about two thirds of the full battery voltage, thereby providing for about one fourth the light output and 200 times longer life expectancy as compared with providing the light bulb with the full battery voltage.

The RMS magnitude of a given voltage existing over a given time period is herein defined as being equal to the magnitude of a non-varying DC voltage which, if applied across a given resistive load for the given time period, would cause the same amount of energy to be absorbed by the given resistive load as would be absorbed by the same given resistive load if subjected to the given voltage for the given time period.

Additional Comments (*a*) The arrangement of FIG. 1 corresponds to a situation of merely adding the indicated electronic circuitry to an otherwise ordinary flashlight having a common (ex: 3 Volt, two-cell) battery and a matching ordinary (ex: 3 Volt, 50 hour) light bulb.

(*b*) The arrangement of FIG. 5 corresponds to a situation of either: (i) using an ordinary-voltage (ex: 3 Volt, two-cell ) battery in combination with a lower-voltage (ex: 2 Volt, 50 hour) light bulb; or (ii) using a higher-voltage (ex: 4.5 Volt, three-cell) battery in combination with an ordinary-voltage (ex: 3 Volt, 50 hour) light bulb; or (iii) using an ordinary-voltage (ex: 3 Volt, two-cell) battery in combination with a matching short-life/high-efficacy (ex: 15 minutes life) light bulb; etc.

(*c*) It is important to realize that in incandescent lamps, such as ordinary light bulbs for flashlights, there is a clear and consistent relationship between luminous efficacy and lamp life. By increasing the RMS magnitude of the voltage applied to a given lamp, the lamp's luminous efficacy increases while its life expectancy decreases. Conversely, by reducing the RMS magnitude of the voltage applied to the lamp, the lamp's luminous efficacy decreases while its life expectancy increases.

(*d*) Clearly, in the arrangement of FIG. 5, instead of reducing the RMS magnitude provided to the light bulb by way of duty-cycling the connection between the light bulb and the battery, a variable resistor means could be used for attaining such a reduction. However, efficiency (and thereby battery life) would then be severely compromised.

(e) In light of instant disclosure, it is clear that the BOOST feature may be also be attained—although only in a nonvariable manner—either: (i) by powering a given light bulb with a two-cell battery and then, to attain a fixed-level BOOST, to switch-in an auxiliary cell such as to increase the RMS magnitude of the voltage applied to the light bulb; or (ii) by connecting to a given battery either one or the other of two light bulbs: one designed for normal operation on the voltage from the given battery, the other designed to provide high-efficacy/short-life operation on that same voltage.

Also, the effect of two light bulbs could be attained by using a light bulb with two filaments.

(f) Just as is the case with forward conversion means FCM of FIG. 1, integrated circuit IC of FIG. 5 may—in the form of a custom integrated circuit made to function in accordance with the functional specifications provided herein—readily and routinely be obtained from a semiconductor manufacturer.

(g) The basic BOOST feature herein disclosed is applicable to various types of battery-powered lighting means, including those wherein the light output is provided by gas discharge lamps.

(h) Clearly, the BOOST feature is basically intended to be used for only a small percentage of the total usage time of a flashlight. Normally, a flashlight with the BOOST feature would have a light bulb that would have a life expectancy of about 50 hours if used continuously in the ON-position and about 15 minutes if used continously in the MAX BOOST position.

In actual usage, it is expected that the flashlight will be used in the plain ON-position most of the time, and in the MAX-BOOST-position for only a small fraction of the time. What is important to understand is that each minute of usage on the MAX-BOOST-position is equivalent—as far as wear of the light bulb is concerned—to over three hours of usage in the plain ON-position. However, due partly to the much increased luminous efficacy associated with the MAX-BOOST-position, battery life will be much less affected by use of the MAX-BOOST-position: continuous operation in the MAX-BOOST-position would only shorten battery life by a factor of two or so; yet, the total net resulting light output (in Lumen-hours) attained from the battery would have doubled.

(i) The word "lamp" is herein defined to include various forms and types of incandescent light bulbs (ex: light bulbs for battery-powered hand-held flashlights) as well as gas discharge lamps (ex: fluorescent lamps for camper lanterns).

(j) In light of the invention herein disclosed, is it clear that the circuit arrangement illustrated by FIGS. 5 and 6 can be used for light DIMMING as well as for light BOOSTING. That is, it would readily be feasible to power the light bulb (in an adjustable manner) at less than the normal amount of power, thereby attaining longer than normal lamp life expectancy.

Also, while provisions are made for spring-loaded automatic return to regular ON-position after having used the BOOST-position, a similar automatic return from a DIM-position would not be necessary. Hence, in some lighting products it would be anticipated that the light control function include a detented OFF-position., a continuous DIMMING-range, a detented ON-position, an automatic-return BOOSTING-range, and an automatic-return MAX-BOOST-position.

(k) Also, by slight modification of the circuit arrangement of FIG. 5, mechanical switch means (such as TPS) may be entirely eliminated. Instead, integrated circuit IC may be made in such manner as to provide for all the required switching functions, for instance by way of a simple high-resistance potentiometer; which would provide both for the ON/OFF function as well as for the continuous-range DIMMING/BOOSTING function.

(l) By using a simple photo-sensor to sense the luminous output from the light bulb, and to feed the output from this photo-sensor back to integrated circuit IC, it is simple to provide for automatic control of luminous output, thereby to compensate for reduced battery output voltage with wear as well as for diminished luminous efficacy as the light bulb ages.

Of course, any changes in battery volt-age can be automatically compensated-for merely by so specifying the IC.

(m) It is anticipated that it be desirable in some cases to filter the current provided to the light bulb, thereby to avoid possible mechanical resonances in the filament due to the high frequency content of the chopped voltage. In the arrangement of FIG. 5, this filtering would not need to consist of more than a filter capacitor connected in parallel with the light bulb and a filter inductor connected in series with the parallel-combination of the light bulb and the filter capacitor.

I claim:

1. A flashlight comprising:

battery means;

lamp means; and control means connected in circuit between the battery means and the lamp means; the control means having a manual adjust means via which it is functional to cause the lamp means to be controllably powered from the battery means; the manual adjust means being characterized by having at least three manually setable positions: (i) an OFF-position in which substantially no power is supplied to the lamp means, (ii) an ON-position in which an ordinary level of power is supplied to the lamp means, and (iii) a BOOST-position in which an extraordinary high level of power is supplied to the lamp means; the BOOST-position being characterized by automatically reverting to the ON-position or the OFF-position, except if continuously being provided with an input to hold it in the BOOST-position.

2. A flashlight comprising:

battery means;

an incandescent lamp having a rated lamp life; and control means connected in circuit between the battery means and the lamp; the control means having a manual adjust means functional to permit the lamp to be controllably powered from the battery means; the manual adjust means being characterized by having at least three manually setable positions: (i) an OFF-position in which substantially no power is supplied to the lamp means; (ii) an ON-position in which a certain level of power is supplied to the lamp, thereby causing the lamp to emit an ordinary level of light and to exhibit a lamp life about equal to or longer than its rated lamp life; and (iii) a BOOST-position in which an extraordinary high level of power is supplied to the lamp means, thereby causing the lamp to emit an extraordinary high level of light but also to exhibit a lamp life substantially shorter than its rated lamp life.

3. A combination comprising:

a battery having battery terminals across which there exists a unidirectional voltage;

an incandescent lamp having lamp terminals;

electronic converter means connected in circuit between the battery terminals and the lamp terminals; the electronic converter means being operative to cause a lamp voltage to be provided across the lamp terminals; the lamp voltage having an RMS magnitude higher than that of the unidirectional voltage; and housing means operative to house the battery, the incandescent lamp and the electronic converter means so as to form a flash-light suitable to be held in and supported by the hand of a human being.

4. An arrangement comprising:

a battery having battery terminals across which there exists a unidirectional voltage;

an incandescent lamp having lamp terminals;

control means connected in circuit between the battery terminals and the lamp terminals; the control means being operative to cause a lamp voltage to be provided across the lamp terminals; the control means including:

(i) a transistor controllably switching between a state of conduction and a state of non-conduction; and (ii) an adjustment means operative, in a substantially non-dissipative manner, to permit manual adjustment of the RMS magnitude of the lamp voltage; and housing means operative to house the battery, the incandescent lamp and the control means, thereby to form a flashlight-type entity suitable for being held in and supported by the hand of a human being.

5. The arrangement of claim 4 wherein the battery is further characterized by including a primary battery.

6. An arrangement comprising:

a battery having battery terminals across which there exists a unidirectional voltage;

an incandescent lamp having lamp terminals;

electronic converter means connected in circuit between the battery terminals and the lamp terminals; the electronic converter means being operative to cause a lamp voltage to be provided across the lamp terminals; the electronic converter means including: (i) an intermittently conducting transistor, the transistor substantively constituting a short circuit when conducting; and (ii) adjustment means functional to permit manual adjustment of the RMS magnitude of the lamp voltage; and housing means operative to house the battery, the incandescent lamp and the electronic converter means so as to form a flash-light suitable to be held in and supported by the hand of a human being.

7. An arrangement comprising:

a battery having battery terminals across which there exists a unidirectional voltage;

an incandescent lamp having lamp terminals;

electronic converter means connected in circuit between the battery terminals and the lamp terminals; the electronic converter means being operative: (i) to cause a lamp voltage to be provided across the lamp terminals, thereby to cause the incandescent lamp to emit light; (ii) to supply current to the lamp terminals in an intermittent manner; and (iii) to draw current from the battery in a continuous manner as long as the lamp is indeed emitting light; and housing means operative to house the battery, the incandescent lamp and the electronic converter means so as to form a flash-light suitable to be held in and supported by the hand of a human being.

8. An arrangement comprising:

a battery having battery terminals across which there exists a first unidirectional voltage having a first RMS magnitude;

an incandescent lamp having lamp terminals;

electronic control means connected in circuit between the battery terminals and the lamp terminals; the electronic control means being operative to cause a second unidirectional voltage to be provided across the lamp terminals; the second unidirectional voltage having a second RMS magnitude; the electronic control means being characterized by having a transistor means alternating between a state of conduction and a state of non-conduction; the state of conduction being substantively equivalent to a short circuit;

adjustment means connected in circuit with the electronic control means and operative to permit manual adjustment of the second RMS magnitude; and housing means operative to house the battery, the incandescent lamp, the electronic control means and the adjustment means, thereby to form a flash-light suitable to be held in and supported by the hand of a human being.

9. An arrangement comprising:

a battery having a battery voltage;

a lamp operative to be powered by energy extracted from the battery; a lamp voltage existing across the lamp;

electronic control means connected in circuit between the battery and the lamp; the electronic control means being operative: (i) to cause the lamp to emit light by extracting energy from the battery; and (ii) to permit manual control of the amount of light emitted by the lamp by controlling the amount of power extracted from the battery, the amount of power being controlled by controlling the RMS magnitude of the lamp voltage; and a housing means functioning to house the battery, the lamp and the electronic control means, thereby to form a product suitable to be held and supported by the hand of a human being;

the arrangement being additionally characterized in that over a given time period, the amount of energy extracted from the battery is substantially equal to the amount of energy supplied to the lamp, even in situations where the magnitude of the lamp voltage is substantially different from that of the battery voltage.

10. The flashlight of claim 9 wherein the electronic control means is characterized by having a transistor means alternating between a state of conduction and a state of non-conduction.

11. An arrangement comprising:

battery means;

lamp means;

control means connected in circuit between the battery means and the lamp means; the control means being operative: (i) to cause the lamp means to generate light from power extracted from the battery means; and (ii) to permit, via controlling a transistor means switching between a state of conduction and a state of non-conduction, manual adjustment of the amount of light generated by the lamp means; and housing means functional to house the battery means, the lamp means and the control means, thereby to form a light generating means suitable for being held and supported by the hand of a human being;

the arrangement being additionally characterized in that the amount of light generated by the light-generating can be adjusted without giving rise to any substantive amount of power dissipation within the control means.

* * * * *